US012435918B2

(12) United States Patent
Wang et al.

(10) Patent No.: US 12,435,918 B2
(45) Date of Patent: Oct. 7, 2025

(54) INSTALLATION FOOT AND REFRIGERATOR HAVING SAME

(71) Applicants: QINGDAO HAIER REFRIGERATOR CO., LTD., Shandong (CN); HAIER SMART HOME CO., LTD., Shandong (CN)

(72) Inventors: Changzhi Wang, Shandong (CN); Bin Fei, Shandong (CN); Enpin Xia, Shandong (CN); Xiaobing Zhu, Shandong (CN); Kang Li, Shandong (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 317 days.

(21) Appl. No.: 18/011,948

(22) PCT Filed: May 8, 2021

(86) PCT No.: PCT/CN2021/092306

§ 371 (c)(1),
(2) Date: Dec. 21, 2022

(87) PCT Pub. No.: WO2021/223750

PCT Pub. Date: Nov. 11, 2021

(65) Prior Publication Data

US 2023/0251016 A1 Aug. 10, 2023

(30) Foreign Application Priority Data

Jun. 30, 2020 (CN) ..... 202010616653.8

(51) Int. Cl.
*F25D 23/00* (2006.01)

(52) U.S. Cl.
CPC ..... *F25D 23/00* (2013.01); *F25D 2323/0011* (2013.01); *F25D 2400/38* (2013.01)

(58) Field of Classification Search
CPC ..... F25D 23/00; F25D 2323/0011; F25D 400/38; A47B 9/00; A47B 9/04;
(Continued)

(56) References Cited

U.S. PATENT DOCUMENTS 1,417,639 A * 5/1922 Sterner ..... A47B 91/028 29/897
2,803,510 A * 8/1957 Carbary ..... B60B 33/06 16/34

(Continued)

FOREIGN PATENT DOCUMENTS

CN 2333979 Y 8/1999
CN 104677030 A 6/2015

(Continued)

OTHER PUBLICATIONS

Chinese Intellectual Property Office (ISR/CN), "International Search Report for PCT/CN2021/092306", China, Jul. 1, 2021.

(Continued)

*Primary Examiner* — Terrell L McKinnon
(74) *Attorney, Agent, or Firm* — troutman pepper locke; Tim Tingkang Xia, Esq.

(57) ABSTRACT

An installation foot and a refrigerator having same, the installation foot including: a support base, a part of which forms a first step portion and a second step portion; a roller wheel, rollably disposed below the second step portion; and an adjustment portion, provided with a screw rod and an adjustment rotary disc, the screw rod being rotatably disposed on the first step portion, and the adjustment rotary disc being fixedly connected to the screw rod or integrated with the screw rod to form a one-piece part so as to drive the (Continued)

screw rod to rotate. In an installation process, the roller wheel is able to roll along a supporting surface on which the installation foot is located, and the screw rod can rotate relative to the support base, so that the installation foot is suitable for both a leveling process and a moving process of an apparatus.

16 Claims, 5 Drawing Sheets

(58) Field of Classification Search
CPC ... A47B 91/022; A47B 91/024; A47B 91/026; A47B 9/028
USPC ..... 248/188.1, 188.2, 188.4, 188.8, 688
See application file for complete search history.

(56) References Cited

U.S. PATENT DOCUMENTS

| | | | | |
|---|---|---|---|---|
| 5,215,367 | A * | 6/1993 | Montuoro | E05D 11/00 248/188.4 |
| 5,971,350 | A | 10/1999 | McCutcheon | |
| 6,601,806 | B2 * | 8/2003 | Wing | B60B 33/0063 248/188.2 |
| 7,908,981 | B2 * | 3/2011 | Agee | A47B 9/04 248/188.4 |
| 8,857,774 | B2 * | 10/2014 | Aoyama | B60B 33/0007 108/177 |
| 9,074,809 | B2 * | 7/2015 | Lee | E05D 7/0423 |
| 9,215,924 | B2 * | 12/2015 | Seefeldt | A47B 21/06 |
| 10,427,701 | B1 * | 10/2019 | Brede | B62B 3/02 |
| 2007/0205342 | A1 * | 9/2007 | Gabriel | F16M 7/00 248/188.4 |
| 2015/0219273 | A1 * | 8/2015 | Demmeler | B25H 1/04 248/188.1 |
| 2023/0251016 | A1 * | 8/2023 | Wang | F25D 23/00 62/259.1 |
| 2023/0251017 | A1 * | 8/2023 | Li | F25D 23/00 62/259.1 |

FOREIGN PATENT DOCUMENTS

| | | | |
|---|---|---|---|
| CN | 105042997 | A | 11/2015 |
| CN | 106568288 | A | 4/2017 |
| CN | 206449079 | U | 8/2017 |
| CN | 210625044 | U | 5/2020 |
| CN | 212778166 | U | 3/2021 |
| JP | H0198879 | A | 4/1989 |
| JP | H06194029 | A | 7/1994 |
| JP | 2001050641 | A | 2/2001 |
| JP | 2007139256 | A | 6/2007 |
| KR | 19980017937 | A | 6/1998 |
| KR | 19990007220 | U | 2/1999 |
| KR | 0136614 | Y1 | 3/1999 |
| KR | 20100000325 | U | 1/2010 |

OTHER PUBLICATIONS

SIPO, "1st CN Office Action and Search Report for CN Application No. 202010616653.8", China.
SIPO, "2nd CN Office Action and Search Report for CN Application No. 202010616653.8", China.
EPO, "Supplementary European Search Report for EP Application No. 21800816.7", Hague, Germany, Sep. 13, 2023.
JPO, "Office Action for JP Application No. 2022-579681", Japan.

* cited by examiner

INSTALLATION FOOT AND REFRIGERATOR HAVING SAME

CROSS-REFERENCE TO RELATED PATENT APPLICATIONS

This application is a U.S. national stage application of PCT Patent Application No. PCT/CN2021/092306 filed on May 8, 2021, which claims priority to and the benefit of Chinese Application No. 202010616653.8 filed Jun. 30, 2020, which are incorporated herein in their entireties by reference.

FIELD OF THE INVENTION

The present invention relates to an apparatus installation technology, and in particular to an installation foot and a refrigerator having same.

BACKGROUND OF THE INVENTION

An installation foot is used to be installed at a bottom of an apparatus to support the apparatus on the ground.

Some of installation feet in the prior art can adjust the parallelism of bottoms of apparatuses when the apparatuses are in a stationary state. However, due to a high friction between the installation foot and the ground in use, it will be very laborious to move the apparatus in an installation process, resulting in difficult operation and low installation efficiency of the entire installation process.

Therefore, how to improve the structure of the installation foot to reduce the installation difficulty of the apparatus has become an urgent technical problem to be solved by those skilled in the art.

BRIEF DESCRIPTION OF THE INVENTION

An object of the present invention is to provide a refrigerator and an installation foot thereof that at least solve any aspect of the above technical problem.

A further object of the present invention is to improve the structure of an installation foot so as to reduce the installation difficulty of an apparatus.

A still further object of the present invention is to reduce or avoid the wear of a roller wheel and thus prolong the service life of an installation foot.

Another still further object of the present invention is to simplify the installation structure of a refrigerator and thus reduce the manufacturing cost.

According to an aspect of the present invention, provided is an installation foot, including: a support base, a part of which forms a first step portion and a second step portion; a roller wheel, rollably disposed below the second step portion; and an adjustment portion, provided with a screw rod and an adjustment rotary disc, the screw rod being rotatably disposed at the first step portion, and the adjustment rotary disc being fixedly connected to the screw rod or integrated with the screw rod to form a one-piece part so as to drive the screw rod to rotate.

Optionally, the rotation axis of the adjustment rotary disc and the screw rod is coaxial with the central axis of the adjustment rotary disc and the central axis of the screw rod; and the adjustment rotary disc extends radially outwards from a bottom section of the screw rod.

Optionally, the first step portion and the second step portion are both horizontal plate wall portions on the support base, and the second step portion is higher than the first step portion; and the adjustment rotary disc is disposed above the first step portion, and an upper surface of the adjustment rotary disc is flush with the second step portion.

Optionally, the first step portion is provided with an unthreaded hole running through a thickness direction of a main body plate surface of the first step portion; the adjustment portion is positioned above the unthreaded hole; and the installation foot further includes a connecting piece, one end of which is fixedly connected to the adjustment portion or integrated with the adjustment portion to form a one-piece part, and the other end of which is matched with a lower peripheral edge of the unthreaded hole to limit the freedom of the adjustment portion to move in a straight line relative to the first step portion in its rotation axis direction.

Optionally, a bottom hole is reserved in the center of a bottom of the adjustment portion; and the connecting piece includes: a screw having a main body portion screwed into the bottom hole, and a head portion located under the main body portion and engaged with the lower peripheral edge of the unthreaded hole; and a washer, disposed between the head portion and the adjustment portion.

Optionally, a first annular flange and a second annular flange are formed on a lower surface of the adjustment portion; the central axis of the first annular flange is coaxial with that of the second annular flange; the second annular flange is higher than the first annular flange; the unthreaded hole allows the first annular flange to extend thereinto and rotatably fit therewith; and the second annular flange is pressed against the first step portion.

Optionally, the roller wheel includes a wheel shaft extending in a horizontal direction, and a wheel body rotating around the wheel shaft; and the support base further includes: a vertical connecting portion, a bottom end of which is connected to one end of the first step portion, and a top end of which is connected to one end of the second step portion, an interstice being reserved between the vertical connecting portion and the adjustment rotary disc; a lateral shaft connecting portion, extending downward from the second step portion and having a shaft hole for matching with the wheel shaft so as to enable the wheel shaft to be rotatably connected to the support base; and an upturned fulcrum portion, used for a connection with a bottom of an apparatus on which the installation foot is installed, the upturned fulcrum portion and the adjustment portion being located on both sides of the roller wheel, respectively.

Optionally, the first step portion and the second step portion are disposed in turn in a horizontal direction; the upturned fulcrum portion includes a plurality of hanging lugs, which are disposed on the second step portion or the lateral shaft connecting portion, and the plurality of hanging lugs are spaced in the horizontal direction; and an extending direction of the wheel shaft is parallel to a direction of a connecting line of the plurality of hanging lugs, and perpendicular to an arrangement direction of the first step portion and the second step portion.

Optionally, the adjustment rotary disc is disc-shaped; and at least one groove or protrusion is formed on an outer peripheral edge of the adjustment rotary disc to match a wrench tool and/or a drive belt.

According to another aspect of the present invention, also provided is a refrigerator, including: at least one installation foot according to any one as described above, disposed at a bottom of the refrigerator, the bottom of the refrigerator being provided with a threaded hole, and the screw rod being in a screwed connection with the threaded hole.

According to the installation foot of the present invention and the refrigerator having same, the installation foot includes the support base, the roller wheel and the adjustment portion. The first step portion and the second step portion are formed on the support base; the roller wheel is rollably disposed below the second step portion; and the adjustment portion is provided with the screw rod rotatably disposed at the first step portion, and the adjustment rotary disc used to drive the screw rod to rotate. In an installation process, the roller wheel is able to roll along a supporting surface on which the installation foot is located, and the screw rod can rotate relative to the first step portion, so that the installation foot of the present invention is both suitable for a leveling process of an apparatus and suitable for a moving process of the apparatus, and is also small in volume, simple and easy to adjust and low in manufacturing cost. By adopting the installation foot of the present invention, the installation difficulty of the apparatus can be reduced, the installation efficiency can be increased, and the labor cost is thus lowered.

Further, according to the installation foot of the present invention and the refrigerator having same, since the screw rod can rotate relative to the first step portion, when the adjustment rotary disc is driven to drive the screw rod to rotate, the first step portion and the second step portion can be stationary, and thus the roller wheel can be prevented from rotating accordingly during the rotation of the screw rod, which not only makes the leveling process of the apparatus easy to operate, and saves time and effort, but also reduces or avoids the wear of the roller wheel and prolongs the service life of the installation foot.

Even further, according to the installation foot of the present invention and the refrigerator having same, the wheel shaft of the roller wheel extends in the horizontal direction, the first step portion and the second step portion are disposed in turn in a horizontal direction, the installation foot can be connected to the bottom of the apparatus provided with the installation foot by means of the upturned fulcrum portion, and the extending direction of the wheel shaft of the roller wheel is parallel to the direction of the connecting line of the plurality of hanging lugs of the upturned fulcrum portion, and perpendicular to the arrangement direction of the first step portion and the second step portion, which is conducive to improving the stability of the installation foot.

Even furthermore, according to the refrigerator of the present invention and the installation foot thereof, because the installation foot of the refrigerator has both a leveling function and a moving function, it is possible to reduce or avoid the installation of other auxiliary structures on the bottom of the refrigerator, thereby simplifying an installation structure of the refrigerator and reducing the manufacturing cost.

The above and other objects, advantages and features of the present invention will be more apparent to those skilled in the art from the following detailed description of specific embodiments of the present invention in conjunction with the accompanying drawings.

BRIEF DESCRIPTION OF THE DRAWINGS

Hereinafter, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In the figures.

DETAILED DESCRIPTION

Figure 1:
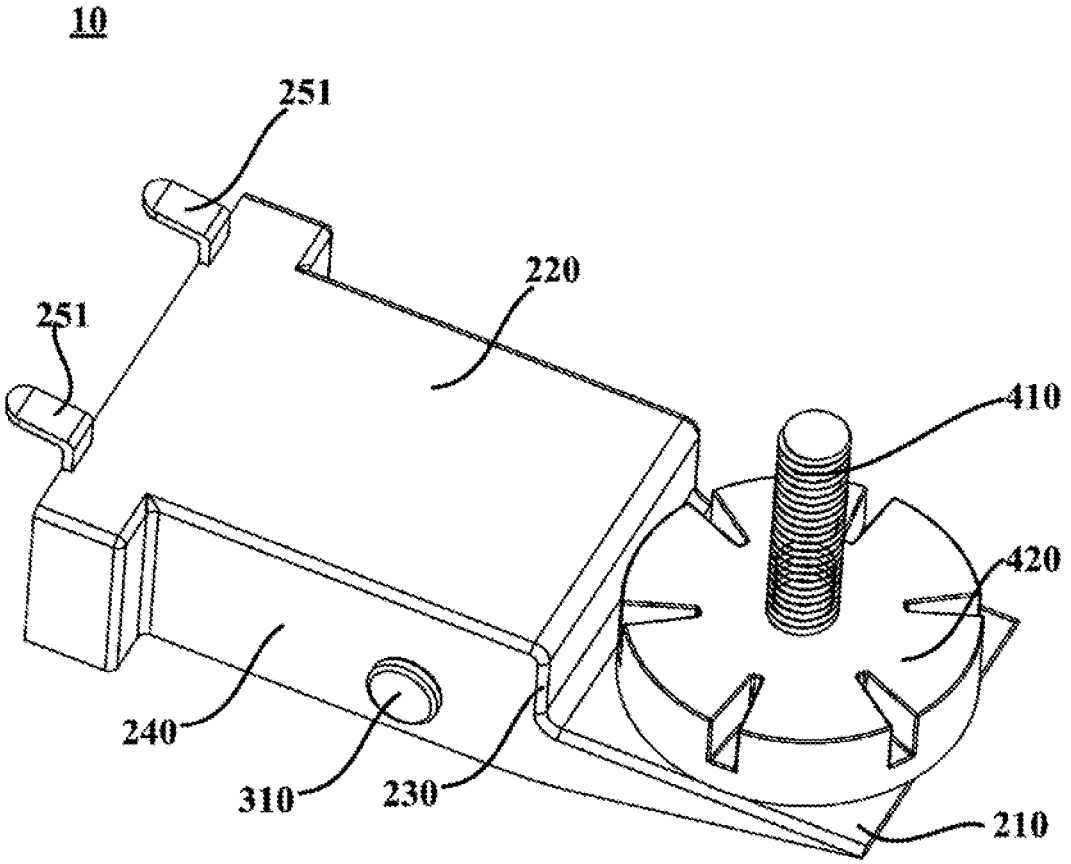
FIG. 1 is a schematic diagram of an installation foot according to an embodiment of the present invention.

FIG. 1 is a schematic diagram of an installation foot 10 according to an embodiment of the present invention. The installation foot 10 of the embodiment is suitable for being installed on a bottom of an apparatus for installing the apparatus to a set position. The installation foot 10 of the embodiment may be applied to various apparatuses, such as a refrigerator 70, an air conditioner, a washing machine, and other household appliances, and may also be applied to any other equipment, especially suitable for the built-in refrigerator 70.

Figure 2:
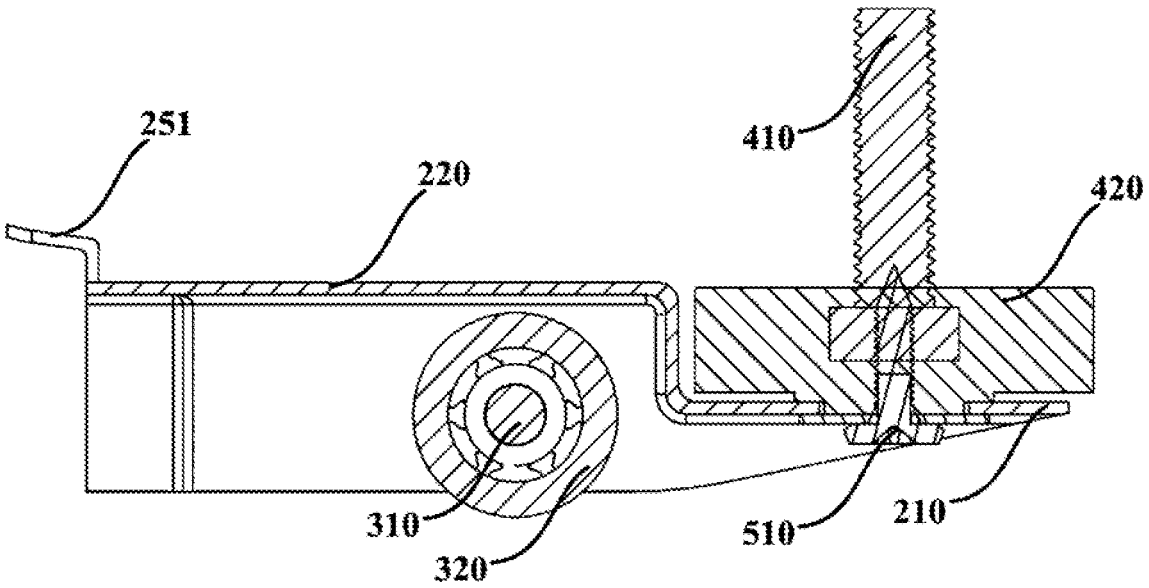
FIG. 2 is a sectional view of the installation foot shown in FIG. 1.

FIG. 2 is a sectional view of the installation foot 10 shown in FIG. 1.

The installation foot 10 may generally include a roller wheel, a support base and an adjustment portion, and may further include a connecting piece. The roller wheel is installed on the support base. The adjustment portion is installed on the support base by means of the connecting piece.

Figure 3:
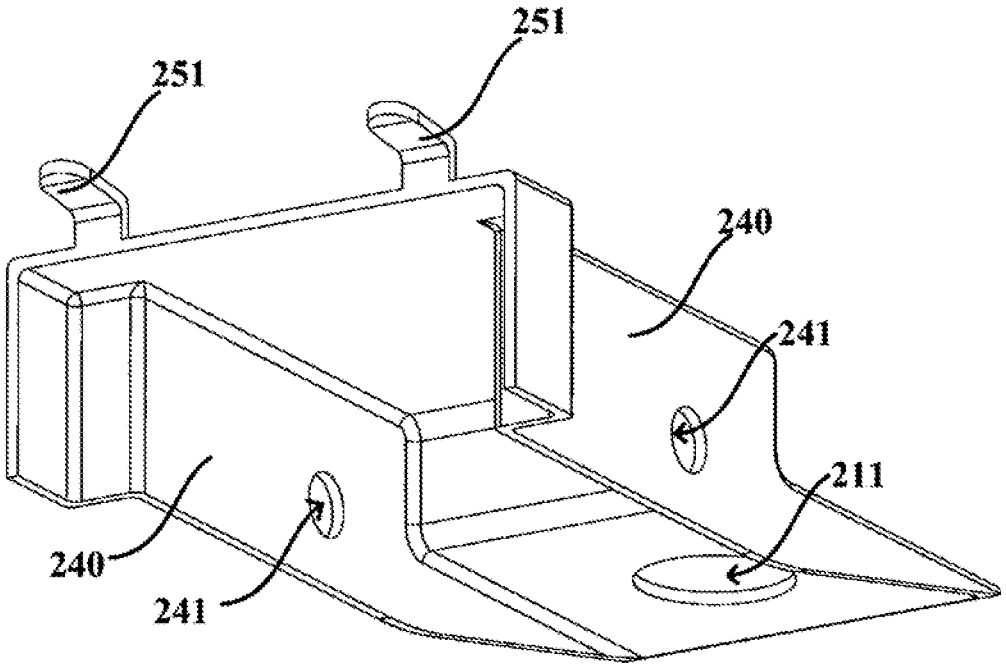
FIG. 3 is a schematic diagram of a support base of the installation foot shown in FIG. 1.

FIG. 3 is a schematic diagram of the support base of the installation foot 10 shown in FIG. 1.

The support base includes a first step portion 210, a second step portion 220, a vertical connecting portion 230, a lateral shaft connecting portion 240, and an upturned fulcrum portion.

A part of the support base forms the first step portion 210 and the second step portion 220. The first step portion 210 and the second step portion 220 are both horizontal plate wall portions on the support base, and the second step portion 220 is higher than the first step portion 210. That is, both the first step portion 210 and the second step portion 220 are horizontal plates extending in a horizontal direction. The shapes of the first step portion 210 and the second step portion 220 may be rectangular, circular, triangular or other arbitrary polygons. In the embodiment, both the first step portion 210 and the second step portion 220 may be substantially rectangular.

The first step portion 210 and the second step portion 220 are disposed in turn in the horizontal direction. For example, the first step portion 210 and the second step portion 220 may be disposed in turn in their length directions, and central axes, extending in the length directions, of the first step portion 210 and the second step portion 220 may be located in the same vertical plane. The widths of main body plate surfaces of the first step portion 210 and the second step portion 220 may be substantially the same. The "length" and the "width" are relative terms, and the length directions of the first step portion 210 and the second step portion 220 are perpendicular to the width directions thereof.

The vertical connecting portion 230 is a connecting plate between the first step portion 210 and the second step portion 220. The vertical connecting portion 230 is disposed substantially in a vertical direction, that is, the vertical connecting portion 230 may be substantially a vertical plate. A bottom end of the vertical connecting portion 230 is connected to one end of the first step portion 210, and a top end of the vertical connecting portion is connected to one end of the second step portion 220.

The lateral shaft connecting portion 240 extends downward from the second step portion 220, and has a shaft hole 241 for matching with a wheel shaft 310 (to be described in detail below) of the roller wheel so as to enable the wheel shaft 310 to be rotatably connected to the support base. In the embodiment, the lateral shaft connecting portion 240 may be a vertical side wall portion on the support base. There may be two lateral shaft connecting portions 240, which are respectively formed by extending downward from two opposite side edges of the second step portion 220 in the width direction. Each lateral shaft connecting portion 240 has the shaft hole 241. The shaft holes 241 of the two lateral shaft connecting portions 240 are disposed opposite to each other. Each shaft hole 241 matches one end of the wheel shaft 310 of the roller wheel. In the embodiment, the two side edges, which are opposite to each other in the width direction, of the first step portion 210 extend downward to form a lateral shielding portion, and the lateral shielding portion and the lateral shaft connecting portion 240 can be a one-piece part.

In other alternative embodiments, the positions and number of the lateral shaft connecting portions 240 may be changed. There may be one lateral shaft connecting portion 240, which is formed by extending downward from the middle part of the second step portion 220. The shaft hole 241 of the lateral shaft connecting portion 240 may match a middle section of the wheel shaft 310 of the roller wheel.

The roller wheel is rollably disposed below the second step portion 220. The roller wheel includes the wheel shaft 310 extending in a horizontal direction and a wheel body 320 that rotates about the wheel shaft 310. The wheel shaft 310 and the adjustment portion are respectively located on both sides of the vertical connecting portion 230.

The first step portion 210, the second step portion 220, the vertical connecting portion 230 and the lateral shaft connecting portion 240 may be a one-piece part.

Figure 4:
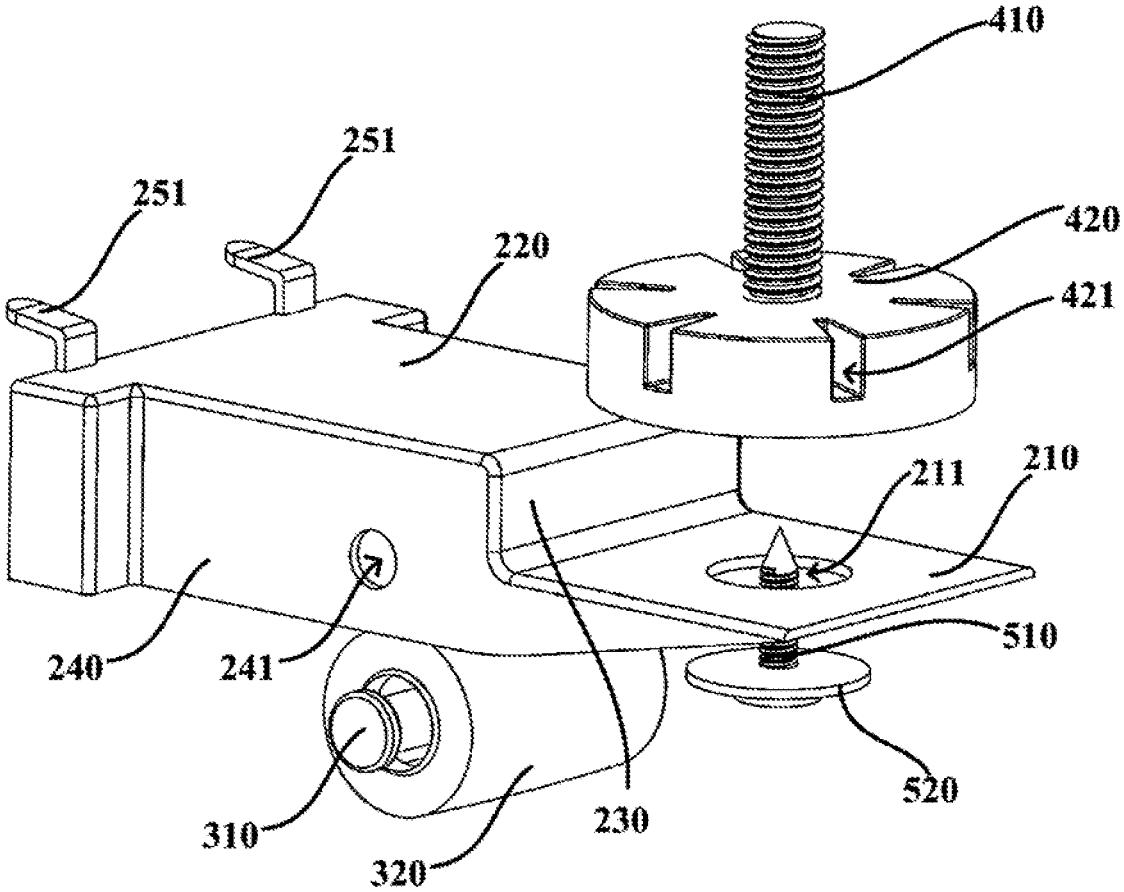
FIG. 4 is an exploded view of the installation foot shown in FIG. 1.

FIG. 4 is an exploded view of the installation foot 10 shown in FIG. 1.

The first step portion 210 is provided with an unthreaded hole 211 running through a thickness direction of the main body plate surface of the first step portion 210. The "thickness" direction may be substantially vertical with respect to an actual use state of the first step portion 210. The unthreaded hole 211 may be located in the middle of the first step portion 210.

The upturned fulcrum portion and the adjustment portion are located on both sides of the roller wheel, respectively, and the upturned fulcrum portion is used for a connection with the bottom of the apparatus on which the installation foot 10 is installed. The upturned fulcrum portion, the roller wheel and the adjustment portion may be disposed in turn approximately in the length directions of the first step portion 210 and the second step portion 220, and the upturned fulcrum portion is located at one end of the support base. The two sides of the roller wheel refer to the two sides in the length directions of the first step portion 210 and the second step portion 220.

In the embodiment, the upturned fulcrum portion includes a plurality of hanging lugs 251, which are disposed on the second step portion 220 or the lateral shaft connecting portion 240, and the plurality of hanging lugs 251 are spaced in a horizontal direction. An extending direction of the wheel shaft 310 is parallel to a direction of a connecting line of the plurality of hanging lugs 251, and perpendicular to an arrangement direction of the first step portion 210 and the second step portion 220. The arrangement direction of the first step portion 210 and the second step portion 220 refers to the length directions of the first step portion 210 and the second step portion 220. That is, the plurality of hanging lugs 251 and the wheel shaft 310 are all disposed in turn in the width directions of the first step portion 210 and the second step portion 220, which is advantageous in improving the stability of the installation foot 10.

The plurality of hanging lugs 251 may be provided at one end of the second step portion 220. The "one end of the second step portion 220" here is opposite to the end, connected with the vertical connecting portion 230, of the second step portion 220. The bottom of the apparatus (e.g., a refrigerator) on which the installation foot 10 is installed may be correspondingly provided with a plurality of connecting holes, each of which allows one of the hanging lugs 251 to extend thereinto, so that the support base is connected to the bottom of the apparatus.

With the length directions of the first step portion 210 and the second step portion 220 being taken as a front and rear extension direction of the support base, the first step portion 210 may be located at a front side of the support base, and the second step portion 220 may be located at a rear side of the support base. Each hanging lug 251 is provided with a vertical insert extending upward from the second step portion 220, and a bent insert extending upward and backward from a top end of the vertical insert. In the embodiment, there may be two hanging lugs 251.

When the adjustment rotary disc 420 drives the screw rod 410 to rotate, a bottom end of the wheel body 320 is pressed against a supporting surface where the apparatus is located. An adjusting fulcrum is formed in a part where the bent insert is connected to the apparatus on which the installation foot 10 is installed, and the apparatus moves up and down around the adjusting fulcrum.

The adjustment portion is located above the unthreaded hole 211. The adjustment portion is provided with the screw rod 410 and the adjustment rotary disc 420. The screw rod 410 is rotatably to disposed at the first step portion 210. The adjustment rotary disc 420 is fixedly connected to the screw rod 410 or integrated with the screw rod 410 to form a one-piece part so as to drive the screw rod 410 to rotate.

When the installation foot 10 is in use, the screw rod 410 is in a screwed connection with a threaded hole at the bottom of the apparatus, and the roller wheel is supported on the supporting surface, for example, the ground, of an installation space where the apparatus is located. During the installation of the apparatus, the roller wheel can roll along the supporting surface where the installation foot 10 is located, and the screw rod 410 can rotate relative to the first step portion 210, so that the installation foot 10 of the embodiment is both suitable for a leveling process of the apparatus and suitable for a moving process of the apparatus. By adopting the installation foot 10 of the embodiment, the installation difficulty of the apparatus can be reduced, the installation efficiency can be increased, and the labor cost is thus lowered.

For example, during the installation of the apparatus, the moving step can be performed first, and then the leveling step is performed. In the moving process, the roller wheel rolls along the supporting surface, which can reduce a frictional resistance during the movement and further reduce the difficulty of the movement. In the leveling step, by using the adjustment rotary disc 420 to drive the screw rod 410 to rotate, the screwing depth of the screw rod 410 into the threaded hole at the bottom of the apparatus can be adjusted so as to adjust the height and/or parallelism of the bottom of the apparatus, with easy operation.

Since the screw rod 410 can rotate relative to the first step portion 210, when the adjustment rotary disc 420 is driven to drive the screw rod 410 to rotate, the first step portion 210 and the second step portion 220 can be stationary, and thus the roller wheel can be prevented from rotating accordingly during the rotation of the screw rod 410, which not only makes the leveling process of the apparatus easy to operate, and saves time and effort, but also reduces or avoids the wear of the roller wheel and prolongs the service life of the installation foot 10.

The rotation axis of the adjustment rotary disc 420 and the screw rod 410 is coaxial with the central axis of the adjustment rotary disc 420 and the central axis of the screw rod 410. The adjustment rotary disc 420 extends radially outwards from a bottom section of the screw rod 410. In the embodiment, the directions of the rotation axis of the adjustment rotary disc 420 and the screw rod 410 may be in a vertical direction. The screw rod 410 may be formed by extending upward from a middle part of the adjustment rotary disc 420.

The adjustment rotary disc 420 is disposed above the first step portion 210, and an upper surface of the adjustment rotary disc 420 is flush with the second step portion 220. The screw rod 410 may extend upward from the bottom section of the adjustment rotary disc 420. When all sections of the screw rod 410 are almost completely screwed into the threaded hole at the bottom of the apparatus, the upper surface of the adjustment rotary disc 420 and the first step portion 210 abut the bottom of the apparatus at the same time, so that the contact area of the installation foot 10 and the bottom of the apparatus is enlarged, and the support stability of the installation foot 10 to the apparatus is improved.

An interstice is reserved between the adjustment rotary disc 420 and the vertical connecting portion 230, which can prevent the vertical connecting portion 230 from interfering with the rotating process of the adjustment rotary disc 420, and improve the smoothness of the rotating process of the adjustment rotary disc 420.

The adjustment rotary disc 420 is disc-shaped; and at least one groove 421 or protrusion is formed on an outer peripheral edge of the adjustment rotary disc 420 to match a wrench tool and/or a drive belt (e.g., a synchronous chain, or a synchronous belt). The adjustment rotary disc 420 may have a set thickness to facilitate the application of a force by the wrench tool and/or the drive belt on the adjustment rotary disc 420. The set thickness can be designed according to actual application conditions, for example, it can be 0.5-10 cm, or it can be any value greater than 10 cm. In other alternative embodiments, the adjustment rotary disc 420 may be square, hexagonal, or any other shape.

Generally, when the installation space of the apparatus is relatively small, the installation personnel cannot reach some parts of the apparatus, which will limit the installation personnel to adjust the apparatus at these parts, resulting in a great difficulty in the leveling process.

The adjustment rotary disc 420 of the embodiment can match the drive belt, and a driving member can be disposed at a position that is easy for the installation personnel to operate, for example, a gear or a cylindrical body with a groove on the outer peripheral edge. The installation foot 10, the drive belt and the driving member can form an installation system. The drive belt is wound around the driving member and the adjustment rotary disc 420, and the adjustment rotary disc 420 can be driven to rotate by rotating the driving member, thereby greatly reducing the leveling difficulty of the apparatus.

For example, when the refrigerator 70 is embedded into a cabinet, the drive belt can be used to drive the adjustment rotary disc 420 to rotate, thereby indirectly driving the screw rod 410 to rotate. Due to the limited internal space of the cabinet, the installation system can reduce the leveling difficulty when the refrigerator 70 is embedded into the cabinet.

The disc diameter of the adjustment rotary disc 420 may be smaller than the length and width of the first step portion 210, and the disc diameter refers to the diameter of a circle where the outer peripheral edge of the disc is located.

One end of the connecting piece is fixedly connected to the adjustment portion or integrated with the adjustment portion to form a one-piece part, and the other end of the connecting piece is matched with a lower peripheral edge of the unthreaded hole 211 to limit the freedom of the adjustment portion to move in a straight line relative to the first step portion 210 in its rotation axis direction. That is, when the adjustment portion is rotated along its rotation axis during installation of the apparatus, the connecting piece will prevent the adjustment portion from moving in the vertical direction relative to the first step portion 210, so that the adjustment portion is not displaced in the vertical direction relative to the first step portion 210.

The connecting piece is not fixedly connected to the lower peripheral edge of the unthreaded hole 211, so that the adjustment portion can only rotate itself without driving the first step portion 210 to rotate together, thereby reducing the rotation resistance and improving the installation efficiency.

In the embodiment, a bottom hole 401 is formed in the center of the bottom of the adjustment portion. The bottom hole 401 can be extended from the adjustment rotary disc 420 to the screw rod 410. The connecting piece includes a screw 510 and a washer 520. The screw 510 has a main body portion screwed into the bottom hole 401, and a head portion located under the main body portion and engaged with the lower peripheral edge of the unthreaded hole 211. The screw 510 can be a self-tapping screw. In other alternative embodiments, the bottom hole 401 may be replaced with a hole having threads. The washer 520 is disposed between the head portion and the adjustment portion. The washer 520 may be circular, the central axis of which is coaxial with that of the unthreaded hole 211, and the diameter of the washer 520 is larger than that of the unthreaded hole 211, so that the washer 520 simultaneously abuts below the lower peripheral edge of the unthreaded hole 211 and below the adjustment portion, and also abuts above the head portion.

Figure 5:
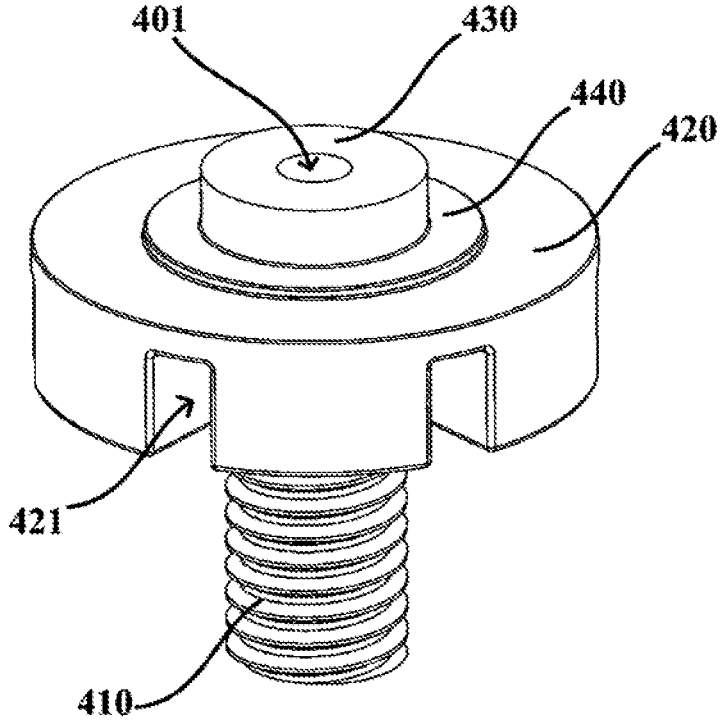
FIG. 5 is a schematic diagram of an adjustment portion of the installation foot shown in FIG. 1.

FIG. 5 is a schematic diagram of an adjustment portion of the installation foot 10 shown in FIG. 1.

A first annular flange 430 and a second annular flange 440 are formed on a lower surface of the adjustment portion. The central axis of the first annular flange 430 and the central axis of the second annular flange 440 are coaxial with each other, and extend in the vertical direction. The second annular flange 440 is higher than the first annular flange 430. The first annular flange 430 and the second annular flange 440 can be formed on a lower surface of the adjustment rotary disc 420.

The unthreaded hole 211 allows the first annular flange 430 to extend thereinto and rotatably fit therewith. By providing the first annular flange 430 and the unthreaded hole 211 that rotatably fit, the stability and centrality of the adjustment portion can be improved in the rotation process, so that the adjustment portion is not easy to be skewed in the rotation process, and the reliability of the installation foot 10 is improved during use.

The second annular flange 440 is pressed against the first step portion 210. The area of a lower surface of the second annular flange 440 is smaller than the overall area of the lower surface of the adjustment rotary disc 420, so that the part of the lower surface of the adjustment rotary disc 420 at an outer side of the second annular flange 440 forms an annular concave surface, and an interstice is reserved between the annular concave surface and the first step portion 210. The second annular flange 440 is only used to directly contact the first step portion 210, which is beneficial to reduce the contact area between the adjustment portion and the first step portion 210, thereby reducing the frictional resistance during the rotation of the adjustment portion.

In some alternative embodiments, a filler may be provided between the annular concave surface and the first step portion 210. The dynamic friction coefficient of one side face of the filler connected to the annular concave surface is small, and the dynamic friction coefficient of one side face of the filler connected to the first step portion 210 is large. By being connected to the annular concave surface of the adjustment rotary disc 420, the filler not only can improve the stability of the adjustment portion in the rotation process, but also can reduce the friction force during the rotation.

Figure 6:
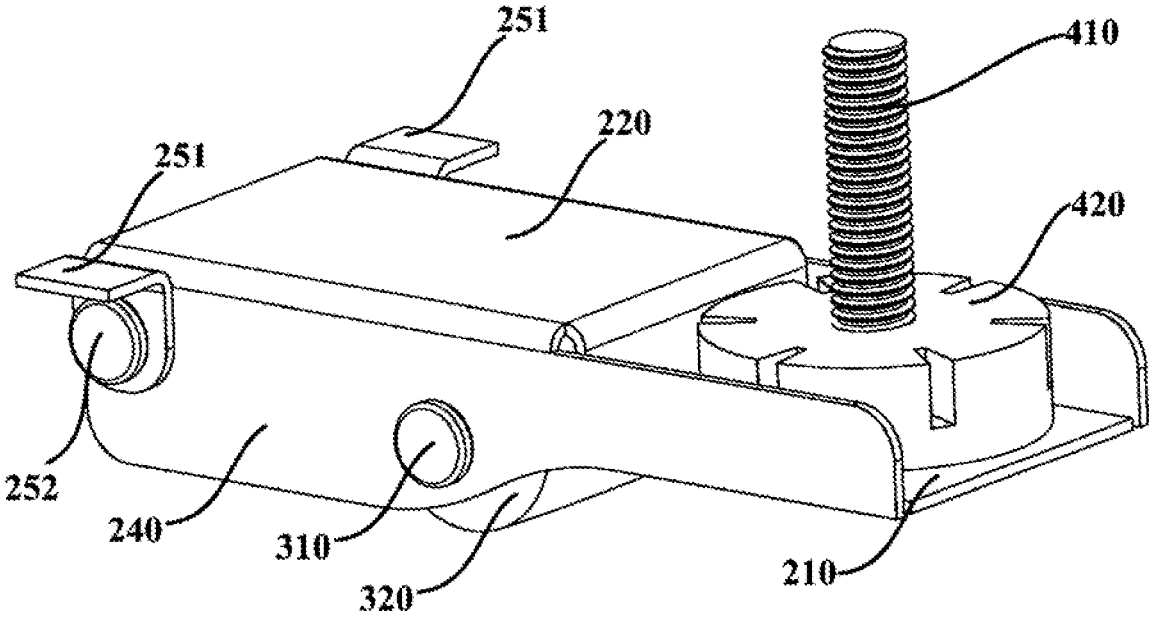
FIG. 6 is a schematic diagram of an installation foot according to another embodiment of the present invention.

FIG. 6 is a schematic diagram of the installation foot 10 according to another embodiment of the present invention.

In some other alternative embodiments, the structure and connection position of the upturned fulcrum portion may be changed. The upturned fulcrum portion may be provided on the lateral shaft connecting portion 240, and includes a plurality of hanging lugs 251 and a connecting shaft 252. The connecting shaft 252 extends in the same direction as the wheel shaft 310, and is disposed below the second step portion 220. The lateral shaft connecting portion 240 is further provided with a connecting hole for matching with the connecting shaft 252, so that the connecting shaft 252 is rotatably connected to the connecting hole. There may be two hanging lugs 251, each hanging lug 251 is provided with a first riveting member riveted with one end of a rotating shaft, and a second riveting member riveted with a bottom of an apparatus, and the first riveting member is fixedly connected to the second riveting member or integrated with the second riveting member to form a one-piece part.

Figure 7:
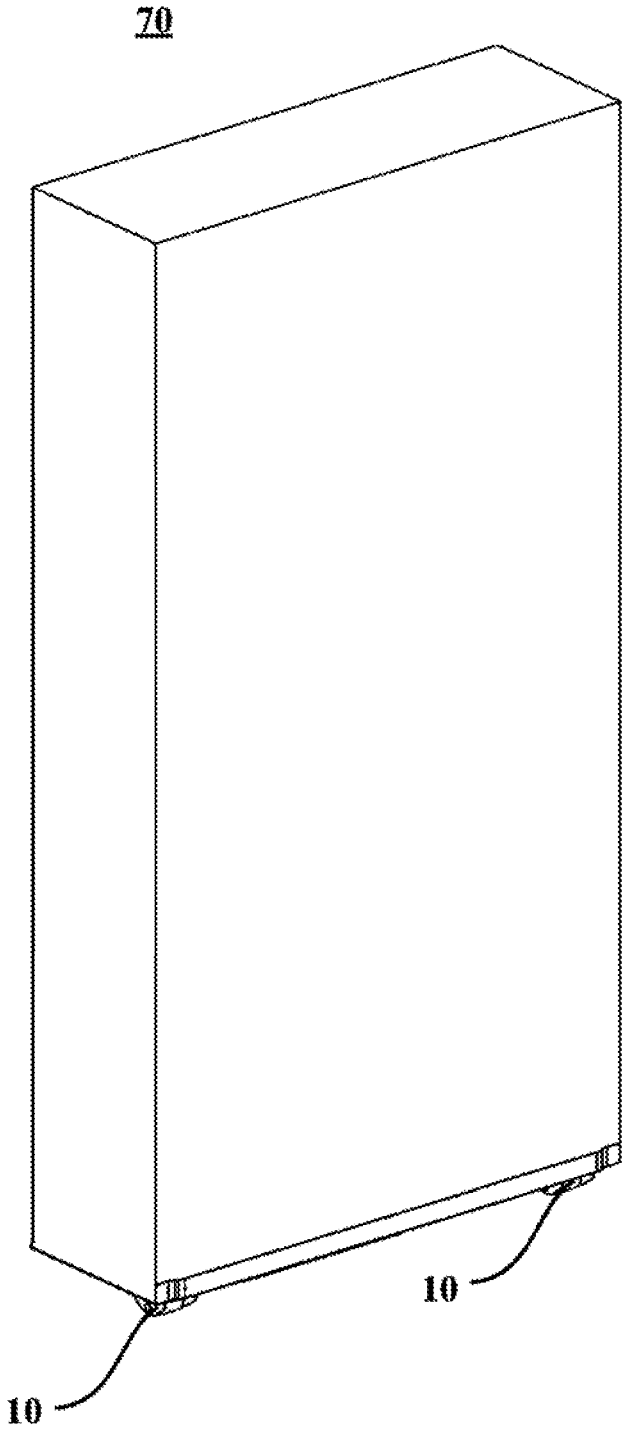
FIG. 7 is a schematic diagram of a refrigerator according to an embodiment of the present invention.

FIG. 7 is a schematic diagram of a refrigerator 70 according to an embodiment of the present invention. At least one installation foot 10 according to any one of the above embodiments is disposed at a bottom of the refrigerator 70. The bottom of the refrigerator 70 is provided with a threaded hole, and the screw rod 410 of the installation foot 10 is in a screwed connection with the threaded hole.

Because the installation foot 10 of the refrigerator 70 of the embodiment has both a leveling function and a moving function, it is possible to reduce or avoid the installation of other auxiliary structures on the bottom of the refrigerator 70, thereby simplifying the installation structure of the refrigerator 70 and reducing the manufacturing cost.

There may be four installation feet 10, two of which may be disposed at a front side of the bottom of the refrigerator 70, and the other two of which may be disposed at a rear side of the bottom of the refrigerator 70.

In some other alternative embodiments, there may be two installation feet 10, both of which are disposed at the rear side of the bottom of the refrigerator 70. The front side of the bottom of the refrigerator 70 may be provided with a rollable front wheel.

Figure 8:
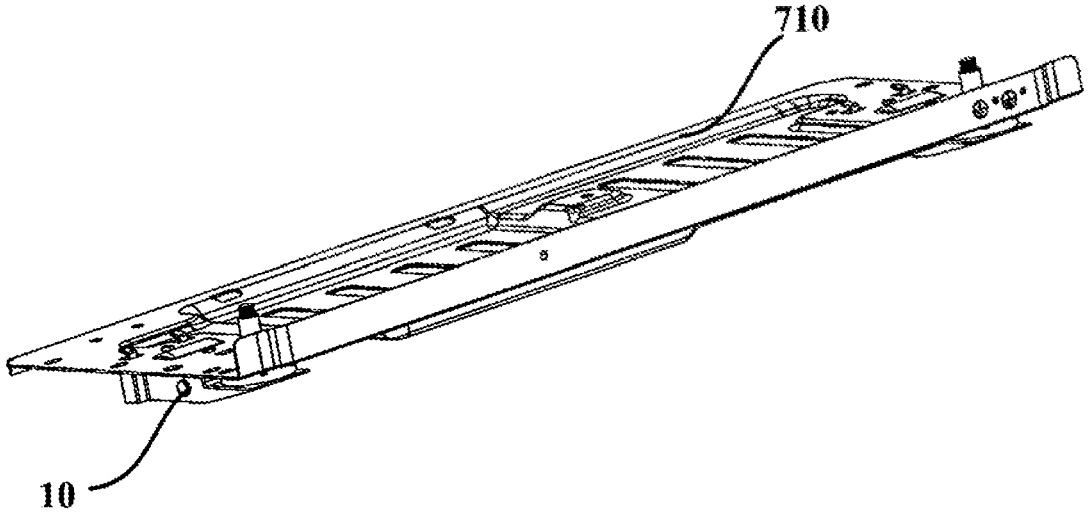
FIG. 8 is a schematic diagram of a bottom plate of a refrigerator and installation feet according to an embodiment of the present invention.

FIG. 8 is a schematic diagram of a bottom plate 710 of a refrigerator 70 and the installation feet 10 according to an embodiment of the present invention.

The threaded hole is formed in the bottom plate 710 of the refrigerator 70. The bottom plate 710 can be directly a bottom plate 710 of a refrigerator body of the refrigerator 70, or can be an additional bottom plate 710 on the refrigerator body. The bottom plate 710 of the refrigerator 70 is provided with a screw cylinder extending upward from a plate surface on which the bottom plate 710 is located, and the threaded hole is formed in the screw cylinder.

According to the installation foot 10 of the embodiment and the refrigerator 70 having same, the installation foot 10 includes the support base, the roller wheel and the adjustment portion. The first step portion 210 and the second step portion 220 are formed on the support base; the roller wheel is rollably disposed below the second step portion 220; and the adjustment portion is provided with the screw rod 410 rotatably disposed on the first step portion 210, and the adjustment rotary disc 420 used to drive the screw rod 410 to rotate. In an installation process, the roller wheel is able to roll along a supporting surface on which the installation foot 10 is located, and the screw rod 410 can rotate relative to the first step portion 210, so that the installation foot 10 of the embodiment is both suitable for a leveling process of an apparatus and suitable for a moving process of the apparatus, and is also small in volume, simple and easy to adjust and low in manufacturing cost. By adopting the installation foot 10 of the embodiment, the installation difficulty of the apparatus can be reduced, the installation efficiency can be increased, and the labor cost is thus lowered.

So far, those skilled in the art should realize that although a plurality of exemplary embodiments of the present invention have been illustrated and described in detail herein, many other variations or modifications consistent with the principles of the present invention may be directly determined or derived from the contents disclosed by the present invention without departing from the spirit and scope of the present invention. Therefore, the scope of the present invention should be understood and deemed to cover all these other variations or modifications.

What is claimed is:

1. An installation foot, comprising:

a support base, a part of which forms a first step portion and a second step portion;

a roller wheel, rollably disposed below the second step portion; and an adjustment portion, provided with a screw rod and an adjustment rotary disc, the screw rod being rotatably disposed at the first step portion, and the adjustment rotary disc being fixedly connected to the screw rod or integrated with the screw rod to form a one-piece part so as to drive the screw rod to rotate;

wherein the roller wheel comprises a wheel shaft extending in a horizontal direction, and a wheel body rotating around the wheel shaft; and the support base further comprises:

a vertical connecting portion, a bottom end of which is connected to one end of the first step portion, and a top end of which is connected to one end of the second step portion, an interstice being reserved between the vertical connecting portion and the adjustment rotary disc;

a lateral shaft connecting portion, extending downward from the second step portion and having a shaft hole for matching with the wheel shaft so as to enable the wheel shaft to be rotatably connected to the support base; and an upturned fulcrum portion, used for a connection with a bottom of an apparatus on which the installation foot is installed, the upturned fulcrum portion and the adjustment portion being located on both sides of the roller wheel, respectively;

wherein the first step portion and the second step portion are disposed in turn in a horizontal direction;

the upturned fulcrum portion comprises a plurality of hanging lugs, which are disposed on the second step portion or the lateral shaft connecting portion, and the plurality of hanging lugs are spaced in the horizontal direction; and an extending direction of the wheel shaft is parallel to a direction of a connecting line of the plurality of hanging lugs, and perpendicular to an arrangement direction of the first step portion and the second step portion.

2. The installation foot according to claim 1, wherein the rotation axis of the adjustment rotary disc and the screw rod is coaxial with the central axis of the adjustment rotary disc and the central axis of the screw rod; and the adjustment rotary disc extends radially outwards from a bottom section of the screw rod.

3. The installation foot according to claim 1, wherein the first step portion is provided with an unthreaded hole running through a thickness direction of a main body plate surface of the first step portion;

the adjustment portion is positioned above the unthreaded hole; and the installation foot further comprises a connecting piece, one end of which is fixedly connected to the adjustment portion or integrated with the adjustment portion to form a one-piece part, and the other end of which is matched with a lower peripheral edge of the unthreaded hole to limit the freedom of the adjustment portion to move in a straight line relative to the first step portion in its rotation axis direction.

4. The installation foot according to claim 3, wherein a bottom hole is reserved in the center of a bottom of the adjustment portion; and the connecting piece comprises:

a screw having a main body portion screwed into the bottom hole, and a head portion located under the main body portion and engaged with the lower peripheral edge of the unthreaded hole; and a washer, disposed between the head portion and the adjustment portion.

5. The installation foot according to claim 4, wherein a first annular flange and a second annular flange are formed on a lower surface of the adjustment portion; the central axis of the first annular flange is coaxial with that of the second annular flange; and the second annular flange is higher than the first annular flange;

the unthreaded hole allows the first annular flange to extend thereinto and rotatably fit therewith; and the second annular flange is pressed against the first step portion.

6. The installation foot according to claim 1, wherein the adjustment rotary disc is disc-shaped; and at least one groove or protrusion is formed on an outer peripheral edge of the adjustment rotary disc to match a wrench tool and/or a drive belt.

7. A refrigerator, comprising:

at least one installation foot according to claim 1, disposed at a bottom of the refrigerator, the bottom of the refrigerator being provided with a threaded hole, and the screw rod being in a screwed connection with the threaded hole.

8. An installation foot, comprising:

a support base, a part of which forms a first step portion and a second step portion;

a roller wheel, rollably disposed below the second step portion; and an adjustment portion, provided with a screw rod and an adjustment rotary disc, the screw rod being rotatably disposed at the first step portion, and the adjustment rotary disc being fixedly connected to the screw rod or integrated with the screw rod to form a one-piece part so as to drive the screw rod to rotate;

wherein the first step portion and the second step portion are both horizontal plate wall portions on the support base, and the second step portion is higher than the first step portion; and wherein the adjustment rotary disc is disposed above the first step portion, and an upper surface of the adjustment rotary disc is flush with the second step portion.

9. The installation foot according to claim 8, wherein the rotation axis of the adjustment rotary disc and the screw rod is coaxial with the central axis of the adjustment rotary disc and the central axis of the screw rod; and the adjustment rotary disc extends radially outwards from a bottom section of the screw rod.

10. The installation foot according to claim 8, wherein the first step portion is provided with an unthreaded hole running through a thickness direction of a main body plate surface of the first step portion;

the adjustment portion is positioned above the unthreaded hole; and the installation foot further comprises a connecting piece, one end of which is fixedly connected to the adjustment portion or integrated with the adjustment portion to form a one-piece part, and the other end of which is matched with a lower peripheral edge of the unthreaded hole to limit the freedom of the adjustment portion to move in a straight line relative to the first step portion in its rotation axis direction.

11. The installation foot according to claim 10, wherein a bottom hole is reserved in the center of a bottom of the adjustment portion; and the connecting piece comprises:

a screw having a main body portion screwed into the bottom hole, and a head portion located under the main body portion and engaged with the lower peripheral edge of the unthreaded hole; and a washer, disposed between the head portion and the adjustment portion.

12. The installation foot according to claim 11, wherein a first annular flange and a second annular flange are formed on a lower surface of the adjustment portion;

the central axis of the first annular flange is coaxial with that of the second annular flange; and the second annular flange is higher than the first annular flange;

the unthreaded hole allows the first annular flange to extend thereinto and rotatably fit therewith; and the second annular flange is pressed against the first step portion.

13. The installation foot according to claim 8, wherein the roller wheel comprises a wheel shaft extending in a horizontal direction, and a wheel body rotating around the wheel shaft; and the support base further comprises:

a vertical connecting portion, a bottom end of which is connected to one end of the first step portion, and a top end of which is connected to one end of the second step portion, an interstice being reserved between the vertical connecting portion and the adjustment rotary disc;

a lateral shaft connecting portion, extending downward from the second step portion and having a shaft hole for matching with the wheel shaft so as to enable the wheel shaft to be rotatably connected to the support base; and an upturned fulcrum portion, used for a connection with a bottom of an apparatus on which the installation foot is installed, the upturned fulcrum portion and the adjustment portion being located on both sides of the roller wheel, respectively.

14. The installation foot according to claim 13, wherein the first step portion and the second step portion are disposed in turn in a horizontal direction;

the upturned fulcrum portion comprises a plurality of hanging lugs, which are disposed on the second step portion or the lateral shaft connecting portion, and the plurality of hanging lugs are spaced in the horizontal direction; and an extending direction of the wheel shaft is parallel to a direction of a connecting line of the plurality of hanging lugs, and perpendicular to an arrangement direction of the first step portion and the second step portion.

15. The installation foot according to claim 8, wherein the adjustment rotary disc is disc-shaped; and at least one groove or protrusion is formed on an outer peripheral edge of the adjustment rotary disc to match a wrench tool and/or a drive belt.

16. A refrigerator, comprising:

at least one installation foot according to claim 1, disposed at a bottom of the refrigerator, the bottom of the refrigerator being provided with a threaded hole, and the screw rod being in a screwed connection with the threaded hole.

* * * * *